United States Patent [19]

Sonneborn et al.

[11] Patent Number: 4,543,753

[45] Date of Patent: Oct. 1, 1985

[54] FLASHING FRAME FOR THE INSTALLATION OF ADJACENT ROOF WINDOWS

[75] Inventors: Siegfried Sonneborn, Tangstedt; Manfred Handel; Ernst Mack, both of Weilheim, all of Fed. Rep. of Germany

[73] Assignee: Rasmussen Holding A/S, Soborg, Denmark

[21] Appl. No.: 468,304

[22] Filed: Feb. 22, 1983

[30] Foreign Application Priority Data

Feb. 26, 1982 [DE] Fed. Rep. of Germany ..... 32068719

[51] Int. Cl.[4] ..... E04D 13/00; E04B 7/18; E06B 1/04

[52] U.S. Cl. ..... 52/15; 52/61; 52/200; 52/211

[58] Field of Search ..... 52/200, 211, 212, 213, 52/474, 475, 208, 209, 476, 14, 15, 58, 59, 60, 61, 62

[56] References Cited

U.S. PATENT DOCUMENTS

| | | | |
|---|---|---|---|
| 1,840,041 | 1/1932 | Kellogg | 52/200 |
| 1,971,160 | 8/1934 | Lenke | 52/459 |
| 3,835,614 | 9/1974 | Downing, Jr. | 52/475 |
| 4,194,325 | 3/1980 | Chalpin, Jr. | 52/200 |
| 4,471,584 | 9/1984 | Dietrich | 52/14 |

FOREIGN PATENT DOCUMENTS

| | | | |
|---|---|---|---|
| 1856279 | 8/1962 | Fed. Rep. of Germany . | |
| 2503519 | 8/1976 | Fed. Rep. of Germany | 52/200 |
| 8000998 | 12/1979 | Fed. Rep. of Germany . | |
| 54-109222 | 8/1979 | Japan | 52/15 |

*Primary Examiner*—John E. Murtagh
*Assistant Examiner*—Andrew J. Rudy
*Attorney, Agent, or Firm*—Michael J. Striker

[57] ABSTRACT

The invention relates to a flashing frame for roof windows to be installed adjacent to each other with edges facing each other in the installed position with a connecting flange of its upper flashing members extending beneath the roofing and, if need be, with its lower flashing members and required intermediary flashing members, obliquely outwardly bent connecting webs and each with a connecting bar with supporting ribs which rearwardly engage the connecting webs being adjacent to the width of the installation distance and are obliquely bent inwardly on both sides, and at least one inner projection which engages between the facing corner edges of the connecting webs in the installed position, thus maintaining these corner edges at the installation distance.

6 Claims, 7 Drawing Figures

FLASHING FRAME FOR THE INSTALLATION OF ADJACENT ROOF WINDOWS

The invention relates to a flashing frame of the type defined in the preamble of claim 1, as well as an associated connecting bar.

Flashing frames of this type were developed by the applicant for the purpose of eliminating overly large intermediary spaces resulting from installation of a plurality of roof windows adjacent to and/or above each other, without impairing the weatherproof connection to the roofing. Although, such flashing frames were very successful, it is very often necessary to adjust the distance between adjacent roof windows to the various distances and cross sectional dimensions of the rafters. For this purpose, not only trough parts of different dimensions, but also a plurality of different upper flashing members must be stored with lengths of the lateral projection of the connecting flange to be adjusted to the installation distance, thus increasing the manufacturing costs and complicating the storage procedure.

It is an object of the invention to improve a flashing frame and the corresponding connecting bars of the type defined in the preamble of claim 1 so that the same upper and/or lower flashing members are connectable in a lateral non-moveable and rain tight manner in different lateral installation distances.

To achieve this object of the invention, the flashing frame of the type defined in the preamble of claim 1 is characterized in accordance with the invention by the characterizing clause of claim 1.

In view of the inventive design of the connecting bar, the same upper flashing members and/or lower flashing members may be used for all installation distances, whereby only the simple and inexpensive connecting bars and trough parts need be finished in different widths. The manufacturing cost is thereby substantially reduced and a substantial saving is also obtained with respect to storing the substantially more expensive upper and lower flashing members. All parts of the flashing frame can be made in a conventional manner from aluminum sheet metal, other sheet metal or from suitable plastic.

Further advantageous designs of the flashing frame are described in claims 2 through 5.

Furthermore, one aspect of the invention for such a flashing frame is a connecting bar having the features contained in claim 1. This connecting bar can be further developed by the features of the of claims 2 through 5.

Figure 1:
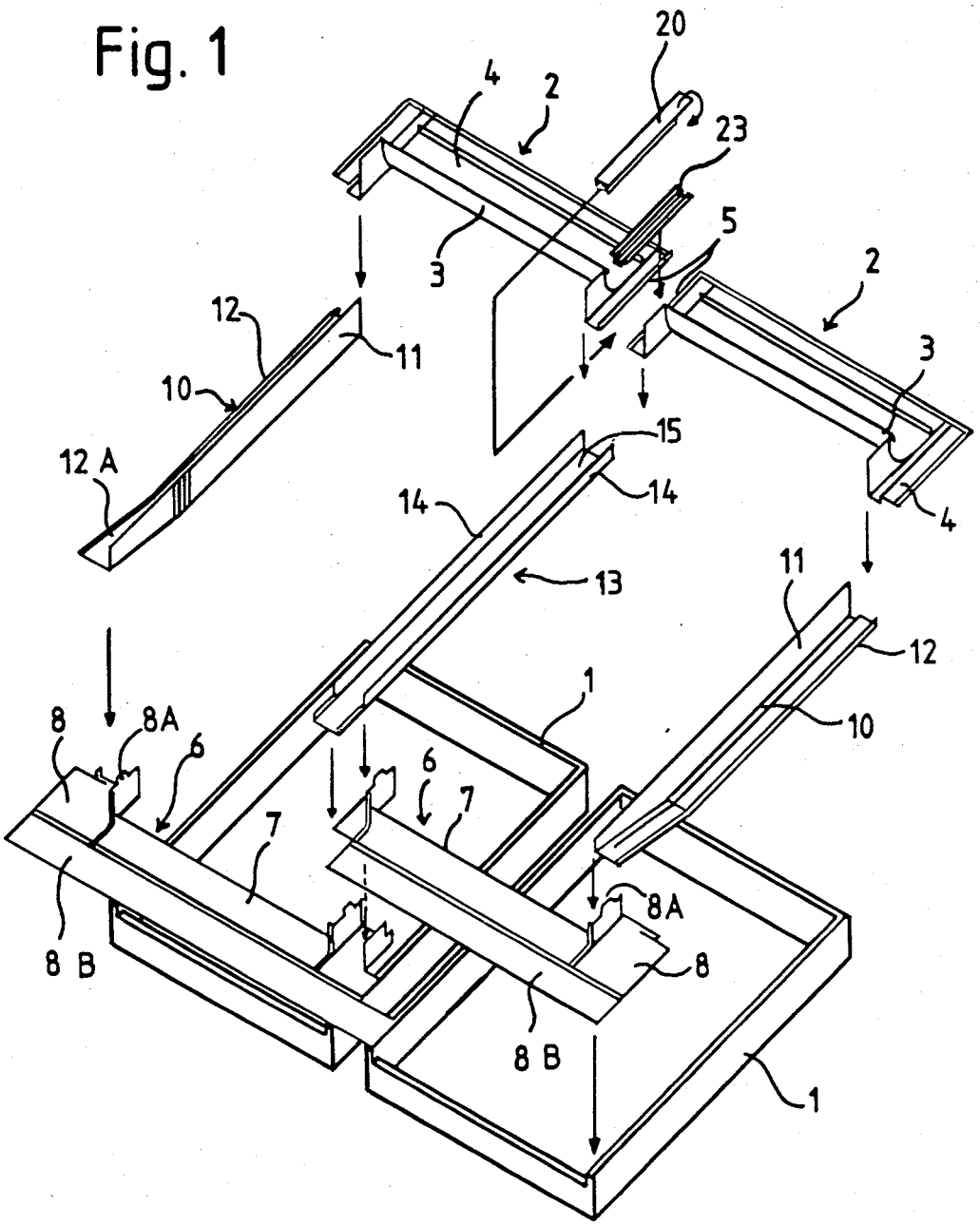
Figure 2:
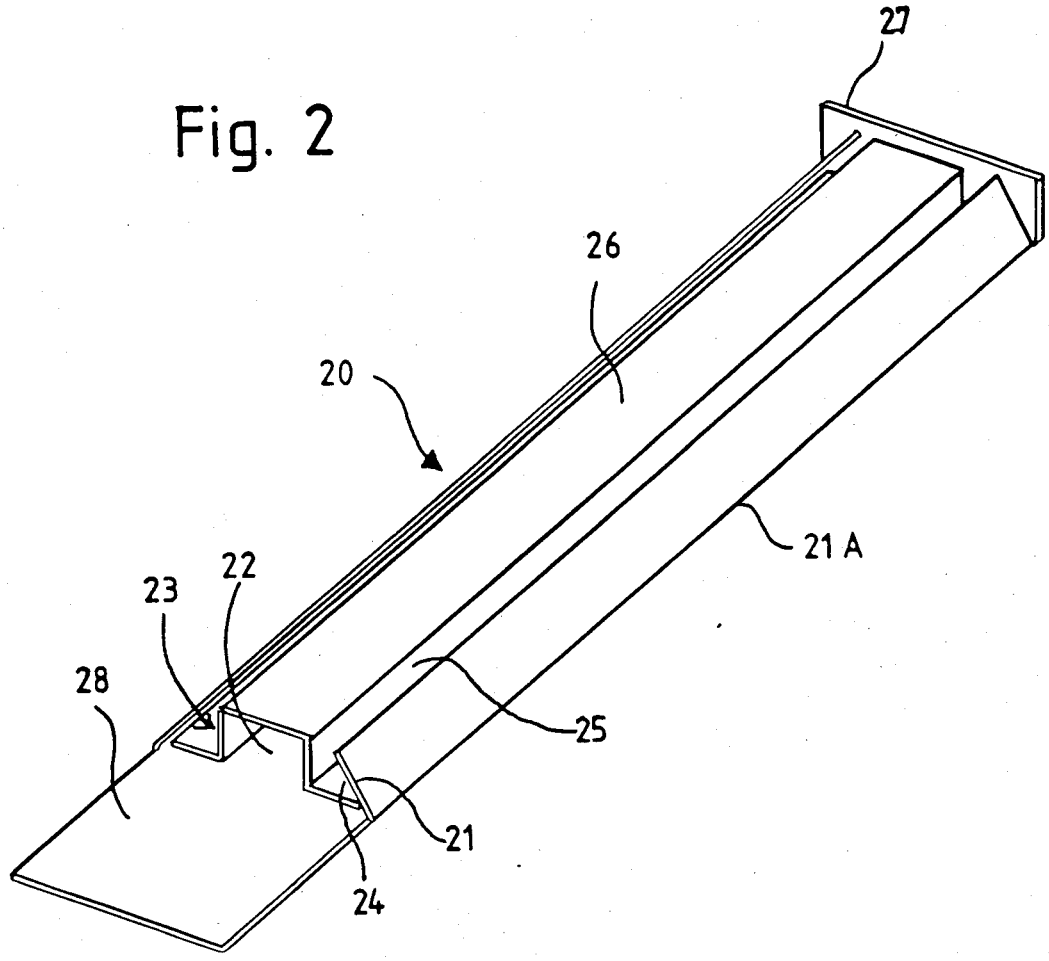
Figure 3:
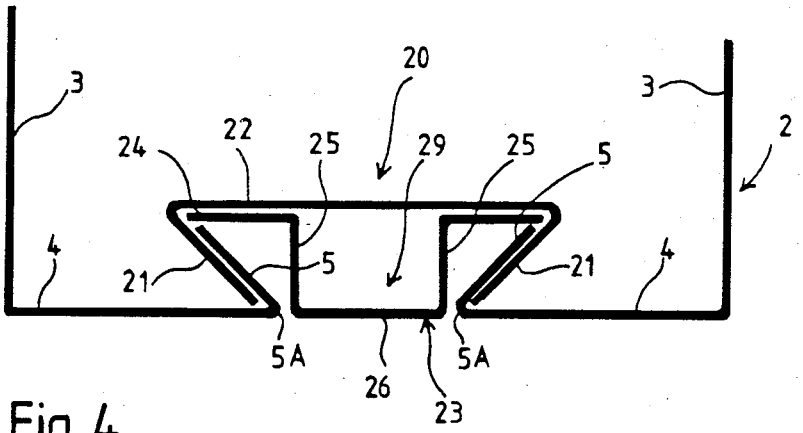
Figure 4:
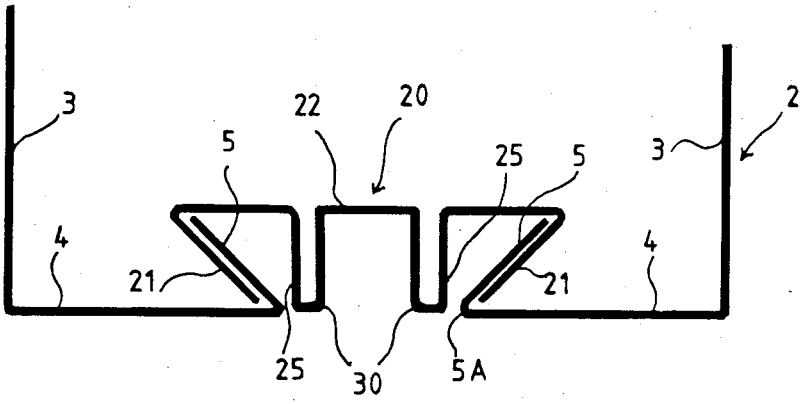
Figure 5:
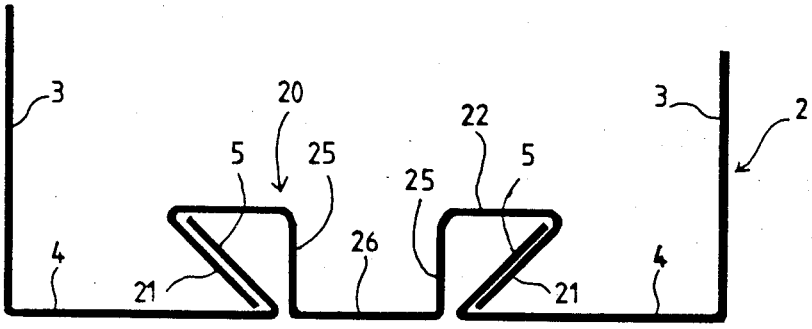
Figure 6:
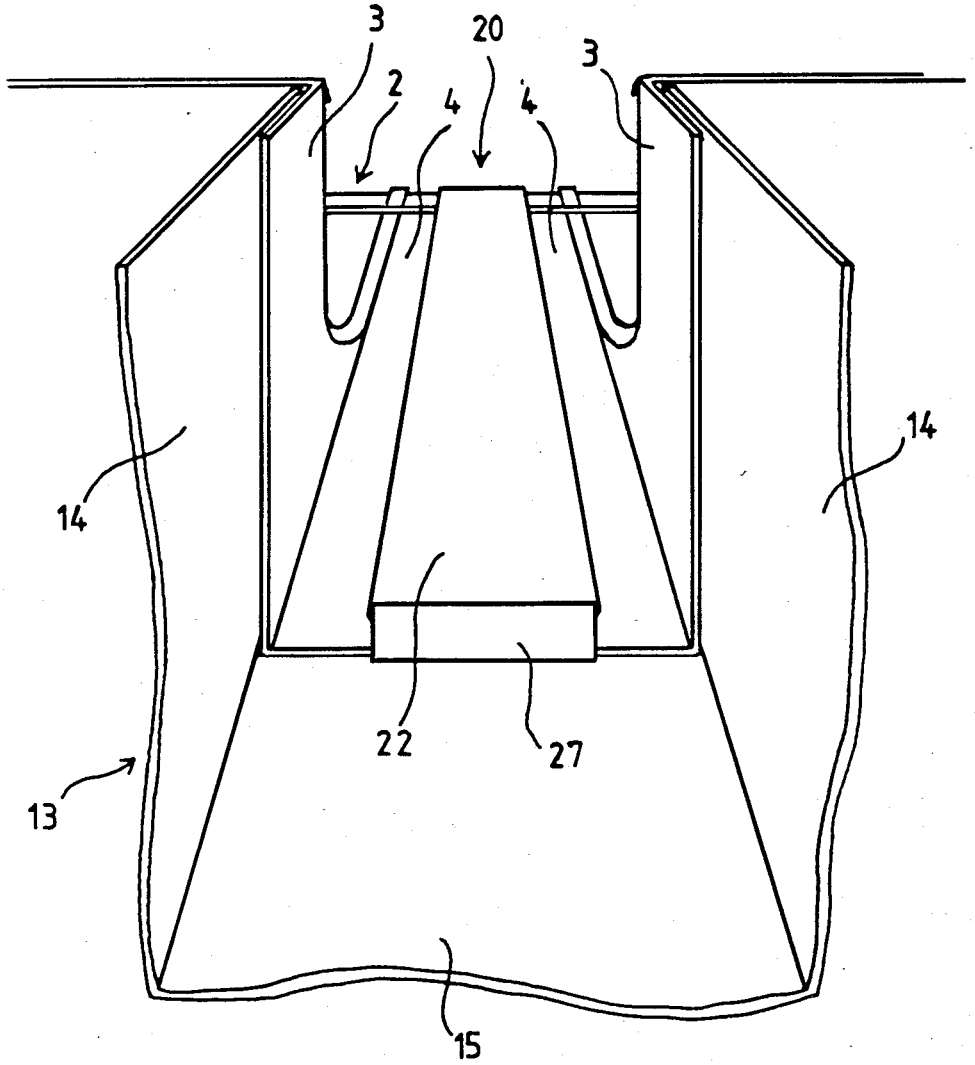
Figure 7:
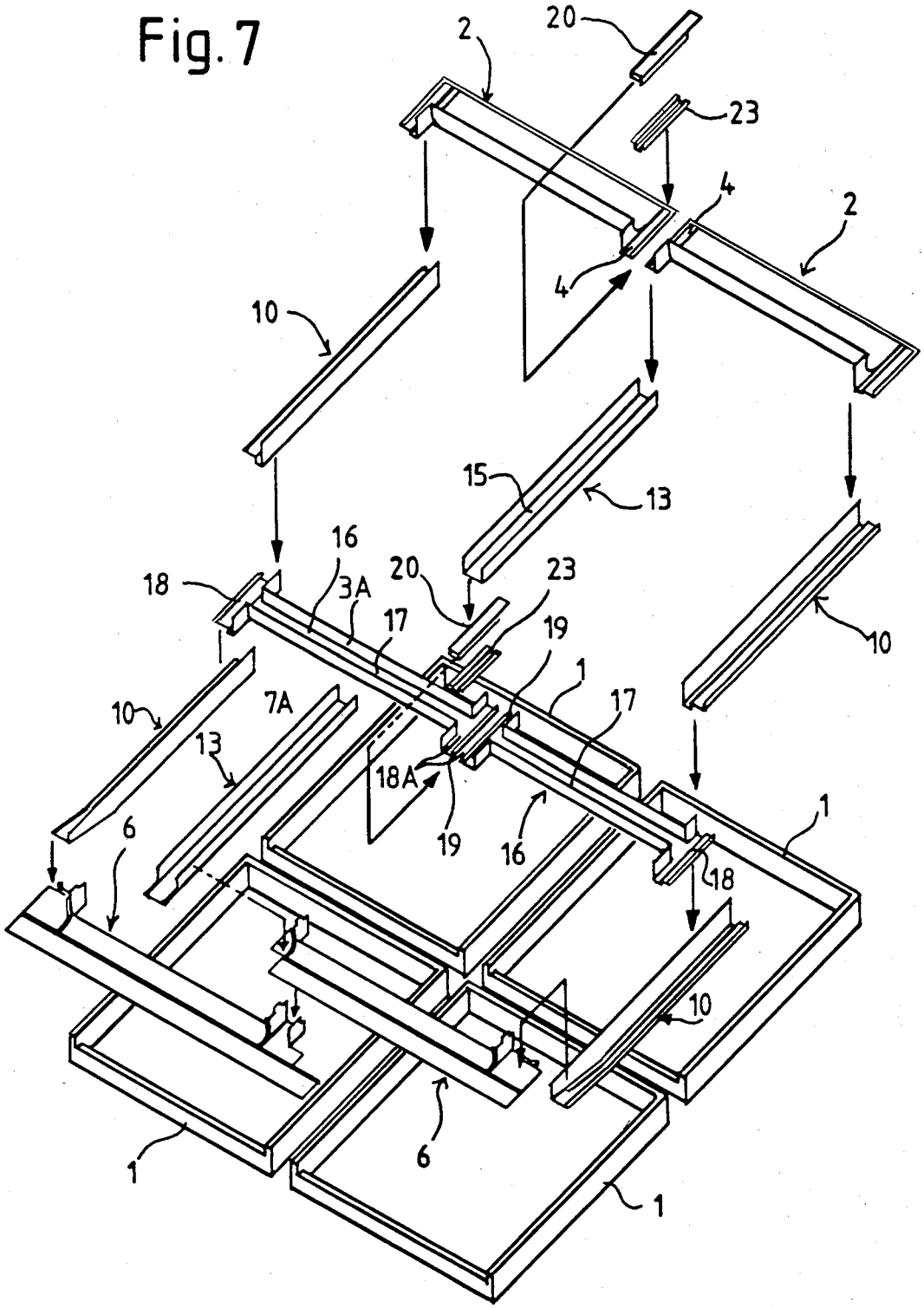

In the following, preferred embodiments of the herein claimed flashing frame are further explained in conjunction with the appended drawings. The drawings show:

FIG. 1 a schematic illustration of the individual parts of a flashing frame for two adjacent roof windows, showing the sequence of the installation, FIG. 2 a perspective view of a preferred embodiment of the connecting bar, FIG. 3 a schematic cross section through the connecting bar in accordance with FIG. 2, in the installed position, FIG. 4 a schematic cross section through a modified connecting bar in the installed condition, FIG. 5 a schematic cross section through a further modified embodiment of the connecting bar in the installed condition, FIG. 6 a perspective partial view of the upper flashing members of a flashing frame with installed connecting bar, and FIG. 7 a schematic perspective view of the individual parts of a flashing frame for two adjacent and two superimposed roof windows, showing the sequence of installation pursuant to the present invention.

As FIG. 1 illustrates, a flashing frame for two adjacent roof windows consists of two upper flashing members 2, two lower parts 6, two side parts 10, a trough part 13, as well as a connecting bar 20 with an associated insertion bar 23.

The upper flashing members 2 are each provided with an upstanding cover flange 3 for covering the upper part of an associated blind frame 1, furthermore, a connecting flange 4 adapted to extend beneath the roofing after installation and an upstanding connecting web 5 bent obliquely and rearwardly at a side edge of said connecting flange. The lower parts flashing members 6 each have one upstanding cover flange 7 for covering the lower part of an associated blind frame 1 and a connecting flange 8 with an associated lead apron 8B which is supported on the gutter side of the roofing in the installed position, whereby the adjacent edge ranges of the connecting flange of the lower flashing members 6 to be installed are so designed in the illustrated embodiment that they can be joined in an overlapping manner at different installation distances. The side flashing members 10 are each provided with an upstanding cover flange 11 for covering side part of the associated blind frame 1, as well as a connecting flange 12 adapted to extend beneath the roofing in the installed position which on the gutter side end has a transition segment 12A which is guided out to the upper side of the roofing in the installed position, this is facilitated by an accordion like folded area of an associated cover rib 11. A trough part 13 having a bottom wall 15 which is adjusted in width to the installation distance and side edges with upstanding cover flanges 14 for the side sections of the two associated blind frames 1. The parts mentioned in this paragraph are of a conventional structure.

The connecting bar corresponds to the two part structure illustrated in FIG. 2, wherein an insertion bar 23 having laterial guide ribs 24 is mounted on a inside of the cover wall 22 by lateral guide ribs 24 engaging in angle formed by the obliquely rearwardly bent coupling webs 21 on the side edges of the cover wall 22. The insertion bar 23 is provided with a trough like center part connecting the guide ribs 24, in the installed position the bottom of this center part forms a support wall 26 at the plane dictated by a pair of corner edges 5A of a set of connecting ribs 5. The support wall 26 is connected with the guide ribs 24 by support webs 25 which act as a support for the corner edges 5A of a connecting flange 4 against a pushing force of a compressing of the two upper flashing members 2. In deviation from the schematic illustration of FIG. 3, the support wall 26 is offset slightly towards the roof relative to the plane of the corner edges 5A for a safe support, so that the support ribs 25 form a reliable abutment for corner edges 5A.

The connecting bar 20 is formed in one piece in the modified embodiment illustrated in FIG. 4, and instead of having the insertion bar 23 it is provided with two recessed trough like reinforcing fins 30 corresponding to the cover wall 22 which form the support webs 25 for the corner edges 5A of connecting webs 5.

In the embodiment illustrated in FIG. 5, the connecting bar 20 is again formed in one piece, whereby instead of the insertion bar 23, a trough like recess from the cover wall 22 is provided whose side walls form the support ribs 25 and whose bottom wall forms the support wall 26.

The connecting bar 20 illustrated in FIG. 2 has a gutter side end which is provided with a rectangular inwardly deflected finishing rib 27 which in the installed position protects the inner space of the connecting bar 20 from the penetration of water driven upwardly by wind. Connection bar 20 has a ridge side end where a support lug 28 is provided forming an extension of the cover wall 22 which in the installed position is bent inwardly around the upper edges of the connecting flange 4 of the associated upper flashing members 2. This configuration of the connecting bar 20 is perspectively illustrated in FIG. 6 in a view from trough part 14 directed upwardly the roof from trough part 14.

The connecting bar illustrated in FIGS. 2 through 5 can also be used for connecting of corresponding connecting bars, not shown, on the facing side edges of connecting flange 8 of lower flashing members 6. In this case too, the lead aprons 8B of the lower flashing members 6 can overlap each other.

In the schematically illustrated embodiment of FIG. 7, the flashing frame for two adjacent and two superposed roof windows, the upper flashing members 2, the lower flashing member 6, the side flashing member 10 and the trough parts 13 correspond to the previously explained parts. One intermediary flashing member 16 is situated between two superposed blind frames 1 in this embodiment and is provided with a bottom wall 17, an upstanding upper cover flange 3A for a covering the lower part of the superposed blind frame 1, an upstanding lower cover flange 7A for covering the upper part of the subjacent blind frame 1, an outer connecting flange 18 and an inner connecting flange 18A which is provided with an obliquely rearwardly deflected connecting web 19. A connecting bar 20 of the type illustrated in FIG. 2 where an inserted insertion bar 23 is used as previously described for a lateral non-movable rain tight connection of the two intermediary flashing members 16. The support lug 28 of the connecting bar 20 which extends over the ridge of the roof is thereby inwardly deflected around elevated edges, not shown, on the upper edge of the inside connecting flange 18A of the two intermediary flashing members 16.

The aforementioned flashing frame explained in conjunction with preferred embodiments and the associated connecting bar can be purposely modified by a person skilled in the art in different ways corresponding to the desired requirements, as long as the lateral non-movable support of the edge corners 5A or 19A of connecting webs 5 or 19 remains intact.

We claim:

1. A flashing frame for installing a plurality of adjacent roof windows inside a blind frame in a plane of a roof, comprising;

a plurality of upper flashing members each having an upstanding cover flange for covering an upper part of an associated blind frame, a connecting flange adapted to extend beneath the roof after installation, and an obliquely rearwardly bent connecting web at a side edge of said connecting flange;

a plurality of lower flashing members each having an upstanding cover flange for covering a lower part of the associated blind frame, a connecting flange adapted to extend onto the roof after installation, and having an obliquely rearwardly bent upstanding connecting web at a side edge of said connecting flange;

a plurality of side parts each having an upstanding cover flange for covering a lower part of the associated blind frame, and a connecting flange which extends beneath the roof after after installation;

at least one trough member installed laterally between two roof windows having two upstanding cover flanges for covering the side parts of two adjacent blind frames; and at least one connecting bar comprising a cover wall having side edges at which obliquely rearwardly bent coupling webs are oriented to engage the associated connecting webs of two upper flashing members, at least one inward support projection extending inwardly from said cover wall between said coupling webs adapted to be disposed after installation between opposed edges of the connecting webs engaged by said coupling webs, said support projection having support webs extending substantially vertical to the roof plane after installation and adapted to support said engaged connecting webs of two adjacent flashing members, said connecting bar having a width adjusted to a predetermined lateral installation distance between the opposed edges of said engaged connecting webs.

2. A flashing frame in accordance with claim 1, wherein the inward support projection of said connecting bar is adapted to substantially fill, after installation, a space between the opposed edges of the engaged connecting webs, comprising a support wall extending in a plane parallel to said cover wall slightly parallelly offset from another plane which extends between the opposed edges of said engaged connecting webs, and having side edges at which rectangular outwardly bent support webs are provided.

3. A flashing frame in accordance with claim 1, wherein the cover wall of the connecting bar has a trough-like depression in its center area which forms the support webs and a support wall connecting the support webs.

4. A flashing frame in accordance with claim 1, wherein the cover wall of the connecting bar is provided with trough-like reinforcing fins which each form a support web for an associated connecting web.

5. A flashing frame in accordance with claim 1, wherein the connecting bar is provided with an insertion bar which forms said inward support projection and has lateral guide ribs which are guided in an angle between one coupling web and the cover wall, said insertion bar having a support wall extending parallel to said cover wall in a plane slightly parallelly offset from another plane which extends between the opposed edges of said connecting webs, and the support wall having side edges at which rectangular bent support webs are provided.

6. A flashing frame in accordance with claim 1, for a plurality of roof windows to be installed side-by-side and above each other, wherein between each pair of superposed roof windows is provided an intermediary flashing member having an upstanding upper cover flange for covering the lower part of the superposed blind frame, an upstanding lower cover flange for covering the upper part of a subjacent blind frame, a bottom wall connecting said upper and lower cover flanges, respectively, and a connecting flange adapted to laterally extend beneath the roofing after installation, each intermediary flashing member having a side to be installed between two laterally adjacent blind frames at which a connecting flange is provided, said connecting flange having a side edge at which an obliquely rearwardly bent connecting web is located.

* * * * *